US011555619B2

(12) United States Patent
Furumoto et al.

(10) Patent No.: US 11,555,619 B2
(45) Date of Patent: Jan. 17, 2023

(54) AIR CONDITIONER

(71) Applicant: SHINWA CONTROLS CO., LTD, Kawasaki (JP)

(72) Inventors: Hideaki Furumoto, Kawasaki (JP); Kazushige Takahira, Kawasaki (JP)

(73) Assignee: Shinwa Controls Co., Ltd., Kawasaki (JP)

( * ) Notice: Subject to any disclaimer, the term of this patent is extended or adjusted under 35 U.S.C. 154(b) by 262 days.

(21) Appl. No.: 16/480,104

(22) PCT Filed: Feb. 5, 2018

(86) PCT No.: PCT/JP2018/003825
§ 371 (c)(1),
(2) Date: Jul. 23, 2019

(87) PCT Pub. No.: WO2018/150928
PCT Pub. Date: Aug. 23, 2018

(65) Prior Publication Data

US 2019/0390861 A1 Dec. 26, 2019

(30) Foreign Application Priority Data

Feb. 14, 2017 (JP) ..... JP2017-025260

(51) Int. Cl.
*F24F 1/0087* (2019.01)
*F24F 3/14* (2006.01)
(Continued)

(52) U.S. Cl.
CPC ..... *F24F 3/153* (2013.01); *F24F 3/048* (2013.01); *F24F 13/02* (2013.01)

(58) Field of Classification Search
CPC .... F24F 3/14; F24F 3/16; F24F 2/0087; F24F 2006/008; F24F 6/02; F24F 6/18;
(Continued)

(56) References Cited

U.S. PATENT DOCUMENTS 2,374,208 A * 4/1945 Jones, Jr. ..... F24F 3/14 165/229
3,699,871 A * 10/1972 Larkfeldt ..... F24F 13/068 454/297

(Continued)

FOREIGN PATENT DOCUMENTS

EP 2 413 052 A1 2/2012
EP 2 5 84 260 A1 4/2013

(Continued)

OTHER PUBLICATIONS

English translation of International Preliminary Report on Patentability (Chapter I) (Application No. PCT/JP2018/003825) dated Aug. 29, 2019, 11 pages.

(Continued)

*Primary Examiner* — Frantz F Jules
*Assistant Examiner* — Jason N Thompson
(74) *Attorney, Agent, or Firm* — Burr & Brown, PLLC

(57) ABSTRACT

An air conditioner according to the present invention includes: an air flow path through which air flows; a temperature control unit that controls a temperature of air in the air flow path; a humidifier capable of supplying vapor to the air flow path; a blower that has a suction port connected to a downstream opening of the air flow path, and a discharge port from which air sucked from the suction port is discharged; a chamber that has a communication port connected to the discharge port, and a plurality of duct connection ports configured to be connectable to ducts so as to let out air coming from the discharge port through the ducts; and a baffle plate part 8 disposed in the chamber, the baffle plate part overlapping at least partly with the discharge port when seen along a flow direction of air passing through the discharge port.

3 Claims, 8 Drawing Sheets

(51) Int. Cl.

| | |
|---|---|
| ***F24F 6/02*** | (2006.01) |
| ***F24F 6/18*** | (2006.01) |
| ***F24F 13/04*** | (2006.01) |
| ***F24F 13/06*** | (2006.01) |
| ***F24F 3/153*** | (2006.01) |
| ***F24F 3/048*** | (2006.01) |
| ***F24F 13/02*** | (2006.01) |

(58) Field of Classification Search
CPC .. F24F 1/037; F24F 13/04; F24F 13/06; F24F 13/062; F24F 13/068
See application file for complete search history.

(56) References Cited

U.S. PATENT DOCUMENTS

| | | | | | |
|---|---|---|---|---|---|
| 3,817,160 | A * | 6/1974 | Searcy | F24F 9/00 | 454/188 |
| 4,023,472 | A * | 5/1977 | Grander | F24F 7/10 | 454/338 |
| 4,261,519 | A * | 4/1981 | Ester | F24F 13/068 | 239/548 |
| 5,056,588 | A * | 10/1991 | Carr | F24F 5/0035 | 165/10 |
| 5,167,681 | A * | 12/1992 | O'Keefe | F24F 8/10 | 55/385.2 |
| 2003/0162492 | A1* | 8/2003 | Caferro | F24F 13/082 | 454/289 |
| 2005/0008542 | A1* | 1/2005 | Yeh | A61B 5/097 | 422/400 |
| 2005/0067723 | A1* | 3/2005 | Parker | F24F 6/043 | 261/26 |
| 2019/0242613 | A1* | 8/2019 | Sasaki | G03F 7/70 | |
| 2020/0049357 | A1* | 2/2020 | Sasaki | F24F 6/08 | |

FOREIGN PATENT DOCUMENTS

| | | | | |
|---|---|---|---|---|
| JP | H03-100723 | U | | 10/1991 |
| JP | H10-047742 | A1 | | 2/1998 |
| JP | H1047742 | A | * | 2/1998 |
| JP | 2002-349903 | A1 | | 12/2002 |
| JP | 2007-113881 | A1 | | 5/2007 |
| JP | 2007-139212 | A1 | | 6/2007 |
| JP | 2007139212 | A | * | 6/2007 |
| JP | 2009-063242 | A1 | | 3/2009 |
| JP | 2010-054095 | A1 | | 3/2010 |
| JP | 5174951 | B2 | | 1/2013 |
| KR | 20-0213380 | Y1 | | 2/2001 |
| WO | 2010/109662 | A1 | | 9/2010 |

OTHER PUBLICATIONS

International Search Report and Written Opinion (Application No. PCT/JP2018/003 825) dated Apr. 3, 2018.
Japanese Office Action (Application No. 2017-025260) dated Jun. 5, 2020 (with English translation).
Korean Office Action (Application No. 10-2019-7024701) dated Jul. 1, 2021 (with English translation).

* cited by examiner

AIR CONDITIONER

FIELD OF THE INVENTION

The present invention relates to an air conditioner. In particular, the present invention relates to technique for preventing temperature and humidity variations in air supplied to a plurality of places.

BACKGROUND ART

In a pattern formation step upon manufacture of semiconductors, photolithography is sometimes used. In the photolithography, a photosensitive resist is firstly applied to a wafer, and then the resist is exposed to light corresponding to a desired pattern. Then, when the resist is a photosetting photosensitive material, an area of the resist, which is not exposed to light, is removed by means of a solvent or the like. Thus, a desired pattern can be formed (developed) in the resist.

In the aforementioned photolithography, it is required to control the temperature and the humidity of the resist uniformly to desired values. This condition is required to make constant a thickness of the resist on the wafer. In a semiconductor manufacturing facility, an air conditioner fulfills the function for satisfying the requirement. Such an air conditioner performs temperature control and humidity control of a resist by supplying an apparatus for applying a resist (referred to as resist application apparatus herebelow) with air whose temperature and humidity are controlled. In the field of an air conditioner of this type, many techniques for improving temperature and humidity control accuracy have been proposed (for example, JP2009-63242A).

SUMMARY OF THE INVENTION

In a semiconductor manufacturing facility, a large manufacturing unit in which a plurality of resist application apparatuses are integrated may be used in order to increase the number of processed wafers. At this time, one air conditioner is provided with a plurality of duct connection ports, and the temperature-and-humidity-controlled air is simultaneously supplied to the resist application apparatuses in the manufacturing unit through ducts connected to the duct connection ports.

However, when air flowing out from the plurality of duct connection ports differs in temperature or humidity, the thickness of the resist may vary from resist application apparatus to resist application apparatus, even if they are in the same manufacturing unit. As a result, there may occur a problem that variations occur in the finished semiconductor components.

The above problem can be alleviated by stirring the temperature-and-humidity-controlled air so as to eliminate distribution. Thus, occurrence of such a distribution can be prevented by taking countermeasures such as increasing a length of a path along which the temperature-and-humidity-controlled air reaches the duct connection port, and a length of a duct connected to the duct connection port. However, such countermeasures are difficult to be taken when reduction of size is required and/or an installation space of a duct is limited. Particularly in a semiconductor manufacturing facility, an air conditioner is generally installed in a place with a low ceiling. Under this condition, it is difficult to take the aforementioned countermeasures. Even if the countermeasures are taken, there is a possibility that the distribution problem cannot be sufficiently solved.

The present invention has been made in view of the above circumstances. The object of the present invention is to provide an air conditioner capable of preventing temperature and humidity variations that may occur in air flowing out from a plurality of duct connection ports, by means of a simple structure that does not require upsizing.

The present invention is an air conditioner comprising: an air flow path through which air flows; a temperature control unit that controls a temperature of air in the air flow path; a humidifier capable of supplying vapor to the air flow path; a blower that has a suction port connected to a downstream opening of the air flow path, and a discharge port from which air sucked from the suction port is discharged; a chamber that has a communication port connected to the discharge port, and a plurality of duct connection ports configured to be connectable to ducts so as to let out air coming from the discharge port through the ducts; and a baffle plate part disposed in the chamber, the baffle plate part overlapping at least partly with the discharge port when seen along a flow direction of air passing through the discharge port.

According to the present invention, since air that has passed through the discharge port of the blower or air that is passing therethrough hits the baffle plate part, the air flow changes so that turbulence can be generated in the chamber. Due to such turn of air or turbulence, it is possible to stir air itself as well as stir air and vapor contained therein in the chamber. Thus, temperature and humidity variations that may occur in air flowing out from the plurality of duct connection ports can be prevented by means of a simple structure that does not require upsizing.

In the air conditioner according to the present invention, the baffle plate part may extend along a direction that diagonally intersects the flow direction of air passing through the discharge port.

In this case, a pressure loss caused by air hitting on the baffle plate part can be reduced, and air can be efficiently let out from the duct connection ports while ensuring a stirring action.

In addition, in the air conditioner according to the present invention, the baffle plate part may have an air-through opening that passes therethrough in a thickness direction, and may be disposed in the chamber such that an airtightness is formed between its whole outer circumference and an inner circumferential surface of the chamber.

In this case, the holding state of the baffle plate part is made stable. In addition, air passing through the air-through opening expands on the downstream side of the baffle plate part. As a result, stirring of air itself, as well as stirring of air and vapor can be promoted.

In addition, in the air conditioner according to the present invention, the air-through opening may be disposed such that a part thereof overlaps with the discharge port and that a remaining part thereof does not overlap with the discharge port, when seen along the flow direction of air passing through the discharge port.

In this case, air that turns by the baffle plate part and then hits on a peripheral portion of the air-through opening to generate turbulence on the downstream side, and air that passes through the air-through opening without hitting on the baffle plate part are mixed with each other. Thus, stirring of air itself, as well as stirring of air and vapor can be effectively promoted.

In addition, in the air conditioner according to the present invention, the air-through opening may be disposed at a position that does not overlap with the discharge port, when seen along the flow direction of air passing through the discharge port.

In this case, the direction of air from the discharge port is firstly turned by the baffle plate part, and then the air hits the peripheral portion of the air-through opening so that turbulence can be generated on the downstream side. Thus, stirring of air itself, as well as stirring of air and vapor can be effectively promoted.

In addition, in the air conditioner according to the present invention, the air-through opening is disposed at a position closer to an end of the baffle plate part, which is farther to the discharge port, than an end of the baffle plate part, which is closer to the discharge port.

In this case, stagnation of air on the upstream side of the baffle plate part can be prevented. Since air can smoothly flows from the discharge port to the air-through opening, pressure loss can be avoided and the blower can be efficiently operated.

In addition, in the air conditioner according to the present invention, the blower may be a centrifugal blower comprising an impeller, a spiral casing part that accommodates the impeller and includes the suction port passing therethrough along an axial direction of the impeller, and a duct part that extends from the spiral casing part and has the discharge port at a distal end thereof; the duct part may be connected to a winding start portion and a winding end portion of a spiral inner circumferential surface of the spiral casing part; and the baffle plate part may be inclined such that an end thereof on the side of the winding start portion is closer to the discharge port than an opposed end thereof, when seen along the axial direction of the impeller.

In this case, when air hits on the baffle plate part, excessive turn of the air can be avoided whereby excessive increase in pressure loss can be avoided. Thus, a stirring action and efficient passing of air can be suitably ensured.

In addition, in the air conditioner according to the present invention, the air flow path, the temperature control unit, the humidifier and the blower may be accommodated inside a housing; the chamber may have an upstream half that is accommodated inside the housing and has the communication port, and a downstream half that is disposed outside the housing; and the duct connection ports may be disposed in the downstream half.

In this case, since the upstream half and the downstream half constitute the chamber, a wide inside space of the chamber can be easily ensured. In addition, degrees of freedom of the positions of the duct connection ports, opening directions thereof and the number thereof can be increased, whereby a degree of freedom of air supply can be improved.

In addition, in the air conditioner according to the present invention, the baffle plate part may be fixed on a circumference of the communication port in the chamber, and at least a portion of the baffle plate part, which overlaps with the discharge port, may extend along a direction orthogonal to the flow direction of air passing through the discharge port.

In this case, turn of air or turbulence can be generated by a significantly simple structure, and it is possible to stir air itself as well as stir air and vapor contained therein in the chamber.

At this time, the circumference of the communication port in the chamber may be provided with a plurality of spaced attachments for attaching the baffle plate part.

In this case, the baffle plate part can be installed in various directions by means of the attachments, whereby a stirring action and efficient air passing can be flexibly controlled, resulting in improvement in handling convenience.

In addition, in the air conditioner according to the present invention, the baffle plate part may be formed by a punching plate that is fixed to cover the whole circumference of the communication port.

In this case, the flow direction of air passing through the discharge port can be widely turned, and turbulence can be generated widely.

According to the present invention, temperature and humidity variations that may occur in air flowing out from the plurality of duct connection ports can be prevented by means of a simple structure that does not require upsizing.

DETAILED DESCRIPTION OF THE INVENTION

Embodiments of the present invention will be described in detail herebelow with reference to the attached drawings.

First Embodiment

Figure 1:
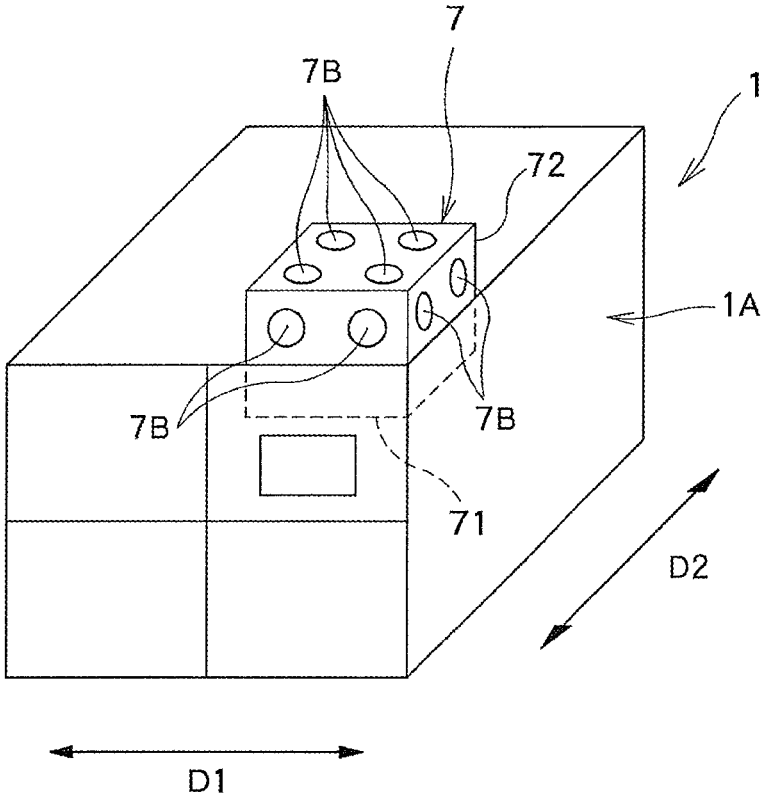
FIG. 1 is a perspective view of an air conditioner according to a first embodiment of the present invention.
Figure 2:
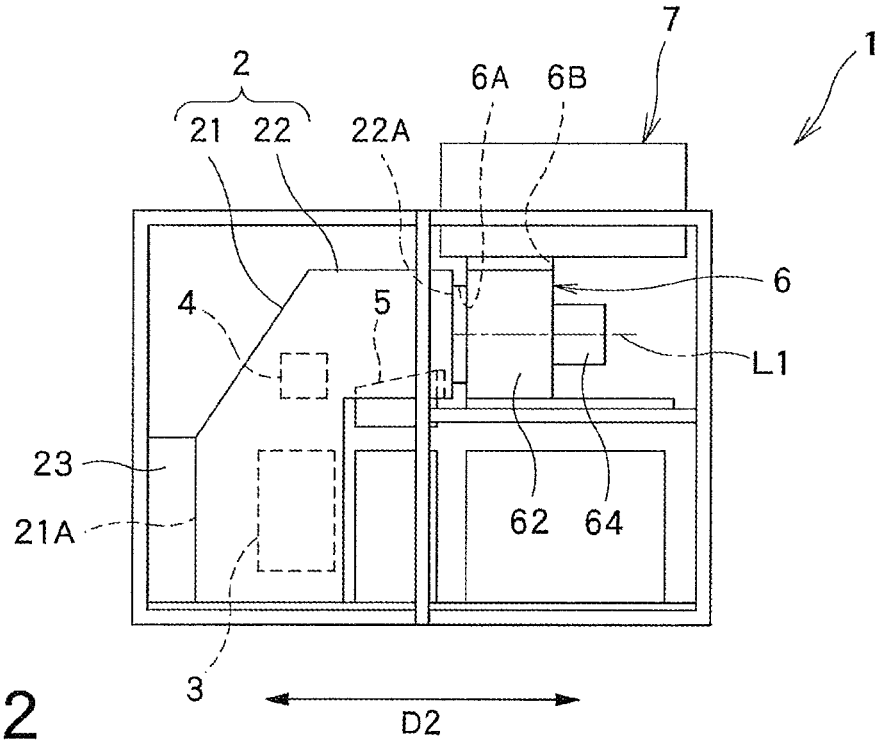
FIG. 2 is a side view of the air conditioner shown in FIG. 1.

FIG. 1 is a perspective view of an air conditioner 1 according to a first embodiment of the present invention. FIG. 2 is a side view of the air conditioner 1. The air conditioner 1 comprises a rectangular parallelepiped housing 1A that accommodates a plurality of members therein. FIG. 2 is a side view of the air condition 1 from which the housing 1A is detached.

As shown in FIG. 2, the air conditioner 1 comprises: an air flow path 2 through which air flows; a cooling unit 3 and a heating unit 4 disposed in the air flow path 2, the cooling unit 3 and the heating unit 4 corresponding to a temperature control unit; a humidifier 5 disposed in the air flow path 2; a blower 6 that applies a driving force for causing air to flow through the air flow path 2; and a chamber 7 that receives air discharged from the blower 6 and then lets out the air. The air flow path 2, the cooling unit 3, the heating unit 4, the humidifier 5 and the blower 6 are accommodated in the housing 1A. The chamber 7 is disposed in an upper part of the housing 1A such that a lower part of the chamber 7 is accommodated in the housing 1A and that an upper part of the chamber 7 is exposed outside the hosing 1A.

The air flow path 2 includes a tubular vertical flow path part 21 that extends along a vertical direction, and a tubular horizontal flow path part 22 that communicates with an upper part of the vertical flow path part 21 and extends from the upper part along a horizontal direction. In the below description, a direction that extends along the horizontal direction in a right and left direction in a sheet plane of FIG. 1 is referred to as a first direction D1. A direction that is orthogonal to the first direction D1 along the horizontal direction is referred to as a second direction D2. The second direction D2 is a direction which the horizontal flow path part 22 extends along its axial direction or its extension direction.

The vertical flow path part 21 has, in its lower part, an upstream opening 21A that opens along the horizontal direction. In this embodiment, the upstream opening 21A opens from inside the vertical flow path part 21 toward one side of the second direction D2 (leftward in FIG. 2). The upstream opening 21A is provided for taking air into the vertical flow path part 21. In this embodiment, a filter device 23 disposed outside the upstream opening 21A covers the upstream opening 21A. Thus, air having passed through the filter device 23 so that particles are removed therefrom is taken from the upstream opening 21A into the vertical flow path part 21. In addition, the horizontal flow path part 22 has, in an end opposite to the vertical flow path part 21, i.e., the other end of the second direction D2, a downstream opening 22A. The horizontal flow path part 22 communicates with the blower 6 through the downstream opening 22A.

In this embodiment, the cooling unit 3 is disposed in the lower part of the vertical flow path part 21, while the heating unit 4 is disposed in the upper part of the vertical flow path part 21. The cooling unit 3 may be an evaporator in a cooling circuit in which a compressor, a condenser, an expansion valve and an evaporator are connected in this order through pipes so that a heating medium circulates therethrough. The heating unit 4 may be an electric heater, or may be a member that uses a part of the heating medium having a high temperature in the aforementioned cooling circuit. The cooling unit 3 has (can control) a variable refrigeration capacity so as to be capable of cooling air inside the air flow path 2. The heating unit 4 has (can control) a variable heating capacity so as to be capable of heating air inside the air flow path 2. A temperature of air in the air flow path 2 is controlled by the cooling unit 3 and the heating unit 4.

The humidifier 5 is disposed in the horizontal flow path part 22, and is capable of supplying vapor into the air flow path 2. Namely, in this embodiment, the humidifier 5 is positioned between the heating unit 4 and the blower 6 in the horizontal direction. The humidifier 5 includes, for example, a storage tank for storing water, which is opened upward inside the horizontal flow path part 22, and a heater for heating the water in the storage tank. By controlling an amount of the vapor by the heater, the humidifier 5 can control humidity of air in the air flow path 2.

Figure 3:
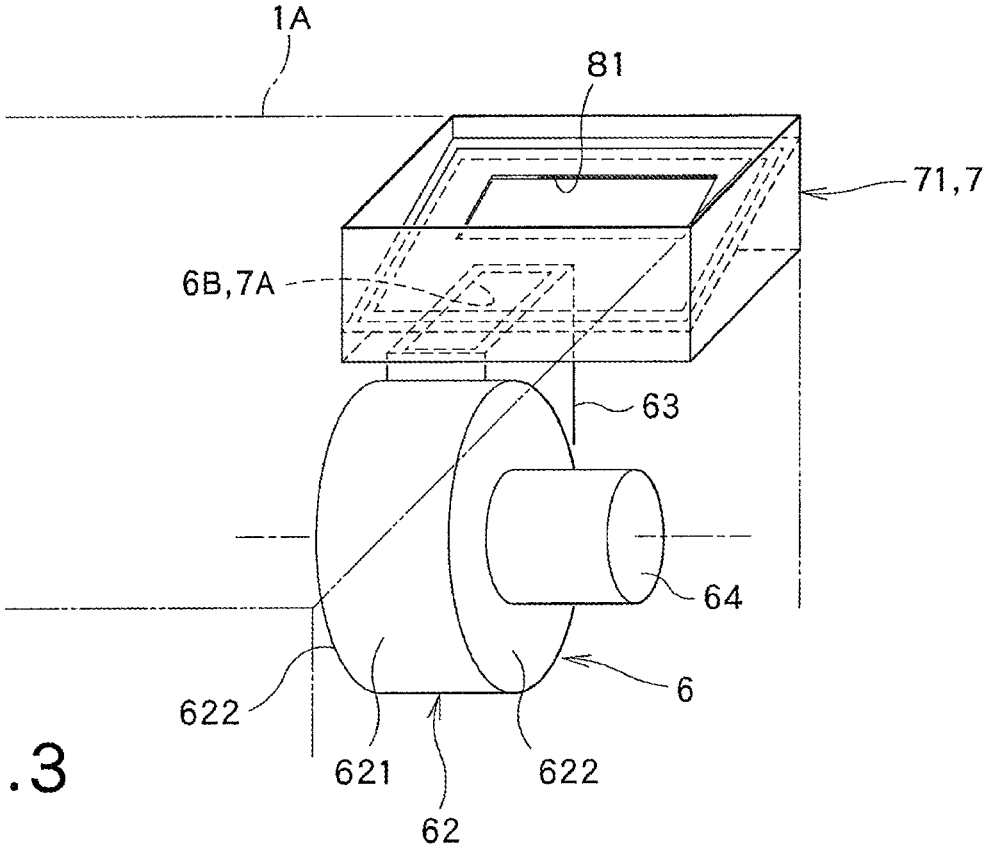
FIG. 3 is a perspective view of a blower and a chamber of the air conditioner shown in FIG. 1.
Figure 4:
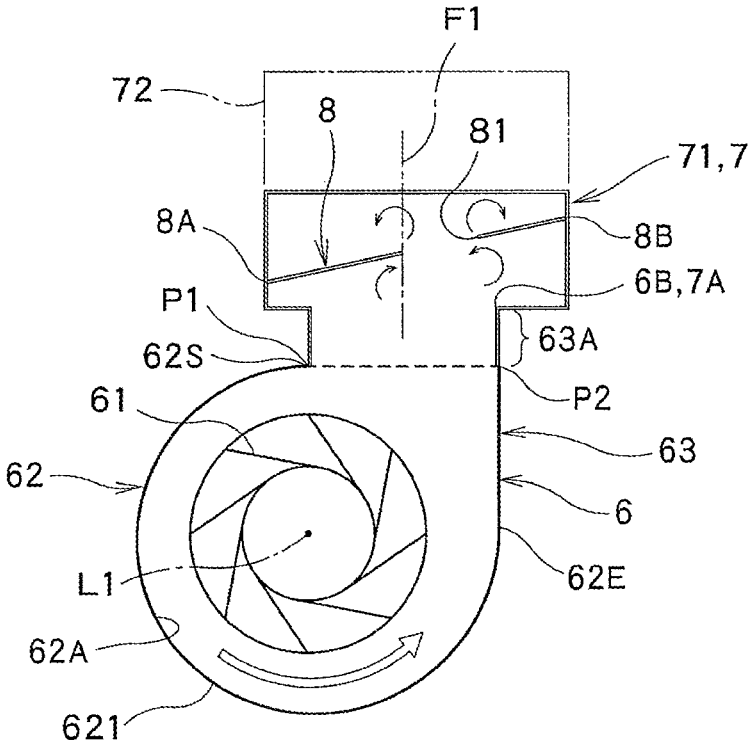
FIG. 4 is a schematic view of the blower and the chamber of the air conditioner shown in FIG. 1.

FIG. 3 is a perspective view of the blower 6 and the chamber 7. FIG. 4 is a schematic view of the blower 6 and the chamber 7 when seen along a rotation axis of the blower 6. As shown in FIGS. 2 to 4, the blower 6 in this embodiment has a suction port 6A (see FIG. 2) connected to the downstream opening 22A of the air flow path 2, and a discharge port 6B from which air sucked from the suction port 6A is discharged. In more detail, the blower 6 in this embodiment is a centrifugal blower which comprises an impeller 61, a spiral casing part 62 that accommodates the impeller 61 and includes the aforementioned suction port 6A passing therethrough the spiral casing part 62 along an axial direction L1 of the impeller 61, and a duct part 63 that extends from the spiral casing part 62 and has the aforementioned discharge port 6B at a distal end thereof. As shown in FIG. 3, the duct part 63 is tubular, and is formed to have a rectangular tube shape in this embodiment, for example. However, its shape is not specifically limited.

As shown in FIG. 4, the spiral casing part 62 includes a circumferential plate part 621 and a pair of side plate parts 622. The circumferential plate part 621 has a spiral inner circumferential surface 62A that defines an air path from the suction port 6A to the discharge port 6B. The inner circumferential surface 62A is configured to enclose the impeller 61 from a winding start portion 62S thereof to a winding end portion 62E thereof. The pair of side plate parts 622 are fixed on both sides in the axial direction L1 of the circumferential plate part 621, and cover the impeller 61 in the axial direction L1. The aforementioned duct part 63 is connected to the winding start portion 62S, the winding end portion 62E and edges of the side plate parts 622 positioned therebetween so as to extend from the spiral casing part 622. The aforementioned suction port 6A is formed in one of the pair of side plate parts 622. A motor 64 for driving the impeller 61 in rotation is disposed on the other of the pair of side plate parts 622. In this embodiment, since the duct part 63 extends upward, the discharge port 6B opens upward. Thus, in this embodiment, the discharge port 6B is vertically connected to the chamber 7.

Such a blower 6 takes thereinto air inside the air flow path 2 and discharges the air to the chamber 7 from the upwardly opening discharge port 6B, by means of the rotation of the impeller 61. When the blower 6 takes thereinto air in the air flow path 2, outside air is taken into the air flow path 2 from the upstream opening 21A. Thus, air flows through the air flow path 2.

As shown in FIGS. 1 to 4, the chamber 7 has a communication port 7A connected to the discharge port 6B of the blower 6, and a plurality of duct connection ports 7B configured to be connectable to ducts (illustration omitted) so as to let out air coming from the discharge port 6B through the ducts. In more detail, the chamber 7 in this embodiment has an upstream half 71 that is accommodated inside the housing 1A and has the communication port 7A, and a downstream half 72 that is disposed outside the housing 1A so as to project form an upper outer surface of the housing 1A. The duct connection ports 7B are disposed in the downstream half 72. In the illustrated example, the upstream half 71 and the downstream half 72 coupled to each other are configured to have a rectangular parallelepiped shape. They are separably coupled by fastening means such as bolts. In addition, in this example, the communication port 7A and the discharge port 6B have the same shape, and the communication port 7A and the discharge port 6B are connected and coincide with each other. However, the communication port 7A may be larger than the discharge port 6B, and may be connected to the discharge port 6B so as to surround the discharge port 6B.

Figure 5:
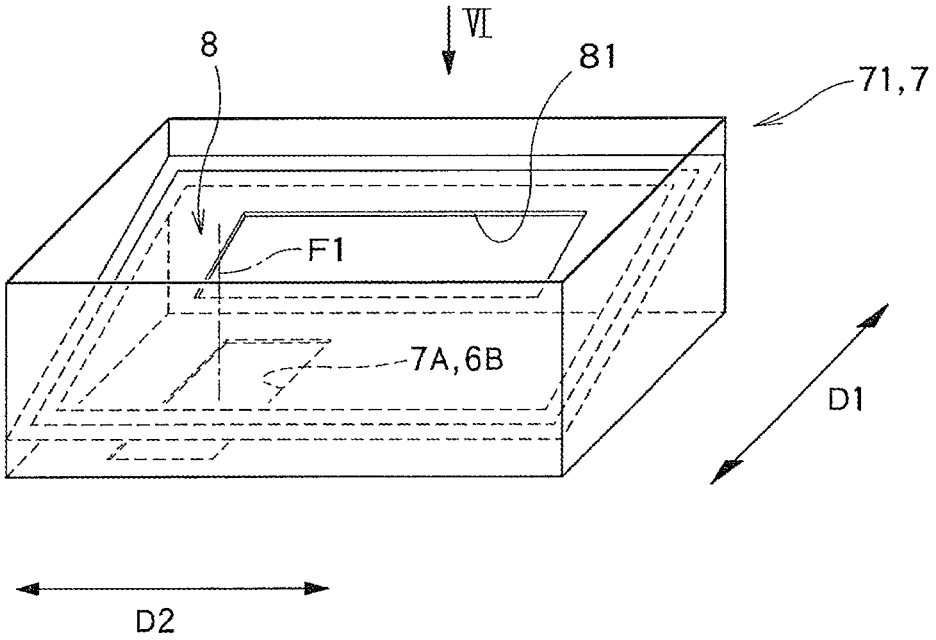
FIG. 5 is a perspective view of the chamber of the air conditioner shown in FIG. 1.
Figure 6:
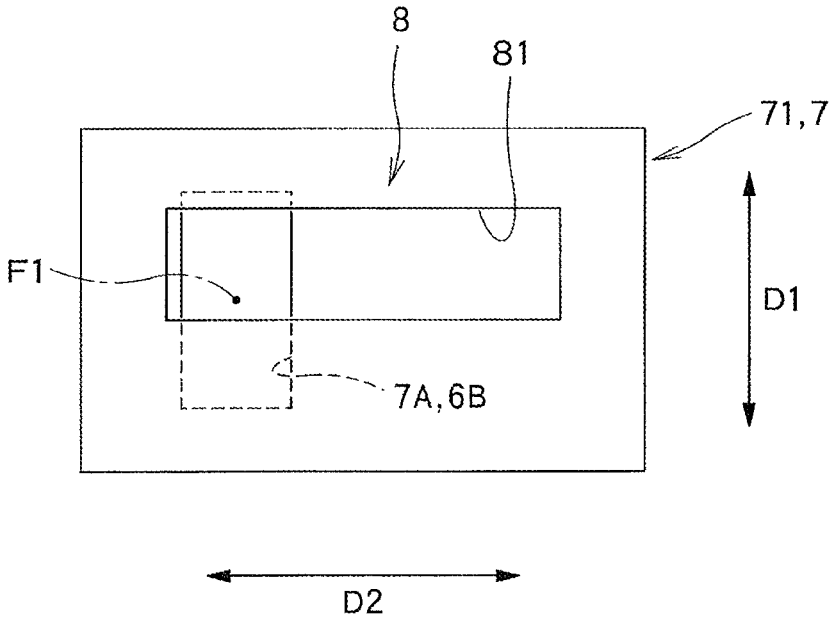
FIG. 6 is a view of the chamber when seen along a direction of an arrow VI of FIG. 5.

FIG. 5 is a perspective view of the upstream half 71 of the chamber 7. FIG. 6 is a view showing the chamber 7 when seen along a direction of an arrow VI of FIG. 5. In FIGS. 5 and 6, the discharge port 6B is illustrated by broken lines for the convenience of explanation. As shown in FIGS. 3 to 6, in this embodiment, a baffle plate part 8 is disposed in the upstream half 71 of the chamber 7. The baffle plate part 8 is a plate-like member. When seen along a flow direction of air passing through the discharge port 6B, the baffle plate part 8 is overlapped at least partly (in this example, one part) with the discharge port 6B. Herein, the "flow direction of air passing through the discharge port 6B" means a direction that extends on an axis F1 that passes a center of the discharge port 6B and a center of each of continuous sections of the duct part 63, each section having the same or similar shape as or to that of the discharge port 6B.

In more detail, in this embodiment, as shown in FIG. 4, a part 63A of the duct part 63, which extends from a portion, which includes a contact point P1 contact with the winding start portion 62S and a point P2 opposed to the contact point P1 in a direction parallel to a plane including a whole circumference of the discharge port 6B, up to the discharge port 6B, has the continuous sections having the same or similar shape as or to that of the discharge port 6B. In this embodiment, the direction that extends on the axis F1 shown in FIGS. 4, 6, etc., which passes the center of the continuous sections and the center of the discharge port 6B, corresponds to the "flow direction of air passing through the discharge port 6B".

The baffle plate part 8 is described in detail. As shown in FIGS. 4 and 5, the baffle plate part 8 in this embodiment extends along a direction that diagonally intersects the flow direction of air passing through the discharge port 6B, i.e., the axis F1. Particularly shown in FIG. 4, when seen along the axial direction L1 of the impeller 61, the baffle plate part 8 is inclined such that its end 8A on the side of the winding start portion 62S is closer to the discharge port 6B than an opposed end 8B. The baffle plate part 8 has an air-through opening that passes therethrough in a thickness direction. The baffle plate part 8 is disposed in the upstream half 71 such that an airtightness is formed between the whole outer circumference of the baffle plate part 8 and an inner circumferential surface of the chamber 7, in particular, the upstream half 71. In this embodiment, an inwardly projecting step is provided on the inner circumferential surface of the upstream half 71, and the baffle plate part 8 is placed on the step, so that baffle plate part 8 is supported aslope. It goes without saying that the supporting manner of the baffle plate part 8 may be otherwise.

As shown in FIG. 6, when seen along the flow direction of air passing through the discharge port 6B, the air-through opening 81 is disposed such that a part thereof overlaps with the discharge port 6B and that a remaining part thereof does not overlap with the discharge port 6B. In addition, as shown in FIG. 4, the air-through opening 81 is disposed at a position closer to an end of the baffle plate part 8, which is farther to the discharge port 6B, than an end of the baffle plate part 8, which is closer to the discharge port 6B.

Due to the provision of the aforementioned baffle plate part 8, in this embodiment, air discharged from the discharge port 6B of the blower 6 to the upstream half 71 flows into the downstream half 72 through the air-through opening 81 of the baffle plate part 8. The air having flown into the downstream half 72 flows out from the duct connection ports 7B. As shown in FIG. 1, in this example, eight duct connect ports 7B are provided. Namely, an upper wall of the downstream half 72, a wall thereof facing one side of the direction D1, a wall thereof facing the other side of the direction D2 are respectively provided with a plurality of the duct connection ports 7B. The number of the duct connection ports 7B and their opening directions are not specifically limited. Each duct connection port 7B is connectable to a duct. By connecting the respective ducts of a plurality of areas whose temperatures are to be controlled (temperature control areas), it is possible to supply air whose temperature and humidity are controlled, from the air conditioner 1 to a plurality of temperature control areas.

Next, an operation of this embodiment is described.

In the air conditioner 1 according to this embodiment, the blower 6 rotates the impeller 61 so that outside air is taken from the upstream opening 21A of the air flow path 2 into the air flow path 2. Thus, the air flows through the air flow path 2. The air having been taken into the air flow path 2 is firstly cooled by the cooling unit 3 and is then heated by the heating unit 4 so as to be controlled to have a desired temperature. After that, the air passes above the humidifier 5 so that its humidity is controlled.

Thereafter, the air is rotated by the impeller 61 in the blower 6 so as to be discharged from the discharge port 6B. The air having been discharged from the discharge port 6B of the blower 6 to the upstream half 71 flows into the downstream half 72 through the air-through opening 81 of the baffle plate part 8. Then, the air having flown into the downstream half 72 flows out from the duct connection ports 7B. At this time, as described above, when the air is discharged from the discharge port 6B of the blower 6 to the upstream half 71, in this embodiment, as shown by the arrows of FIG. 4, since the air hits on the baffle plate part 8, the air flow changes so that turbulence can be generated in the chamber 7. Due to such turn of air or turbulence, it is possible to stir air itself as well as stir air and vapor contained therein in the chamber 7. Thus, temperature and humidity variations that may occur in air flowing out from the plurality of duct connection ports 7B can be prevented by means of a simple structure that does not require upsizing.

As described above, the air conditioner 1 according to this embodiment comprises: the air flow path 2, the cooling unit 3 and the heating unit 4 which correspond to a temperature control unit that controls a temperature of air in the air flow path 2; the humidifier 5 capable of supplying vapor to the air flow path 2; the blower 6 that has the suction port 6A connected to the downstream opening 22A of the air flow path 2, and the discharge port 6B from which air sucked from the suction port 6A is discharged; the chamber 7 that has the communication port 7A connected to the discharge port 6B, and the plurality of duct connection ports 7B configured to be connectable to ducts so as to let out air from the discharge port 6B through the ducts; and the baffle plate part 8 disposed in the chamber 7, the baffle plate part 8 overlapping at least partly with the discharge port 6B when seen along the flow direction of air passing through the discharge port 6B. Thus, temperature and humidity variations that may occur in air flowing out from the plurality of duct connection ports 7B can be prevented by means of a simple structure that does not require upsizing.

In addition, in this embodiment, the baffle plate part 8 extends along the direction that diagonally intersects the flow direction of air passing through the discharge port 6B. Thus, a pressure loss caused by air hitting on the baffle plate part 8 can be reduced, and air can be efficiently let out from the duct connection ports 7B while ensuring a stirring action.

Particularly in this embodiment, the blower 6 is a centrifugal blower, and the baffle plate part 8 is inclined such that the end 8A on the side of the winding start portion 62S is closer to the discharge port 6B than the opposed end 8B, when seen along the axial direction L1 of the impeller 61. Thus, when air hits on the baffle plate part 8, excessive turn of the air can be avoided whereby excessive increase in pressure loss can be avoided. Thus, a stirring action and efficient passing of air can be suitably ensured. Namely, air discharged from the centrifugal blower is likely to have a component flowing toward the winding end portion 62E. In the structure of this embodiment, the direction of the thus flowing air is similar to the inclination direction of the baffle plate part 8. Thus, excessive turn of the air can be avoided whereby excessive increase in pressure loss can be avoided.

In addition, the baffle plate part 8 in this embodiment has the air-through opening 81 passing therethrough in the thickness direction, and is disposed in the chamber 7 such that a space between its whole outer circumference and the inner circumferential surface of the chamber 7 (upstream half 71) is airtight. Thus, the holding state of the baffle plate part 8 is made stable. In addition, air passing through the air-through opening 81 expands on the downstream side of the baffle plate part 8. As a result, stirring of air itself, as well as stirring of air and vapor can be promoted.

In addition, the air-through opening 81 is disposed such that a part thereof overlaps with the discharge port 6B and that a remaining part thereof does not overlap with the discharge port 6B, when seen along the flow direction of air passing through the discharge port 6B. Thus, air that turns by the baffle plate part 8 and then hits on a peripheral portion of the air-through opening 81 to generate turbulence on the downstream side, and air that passes through the air-through opening 81 without hitting on the baffle plate part 8 are mixed with each other. Thus, stirring of air itself, as well as stirring of air and vapor can be promoted.

In addition, the air-through opening is disposed at a position closer to the end 8B of the baffle plate part 8, which is farther to the discharge port 6B, than the end 8A of the baffle plate part 8, which is closer to the discharge port 6B. Thus, stagnation of air on the upstream side of the baffle plate part 8 can be prevented. Since air can smoothly flows from the discharge port 6B to the air-through opening 81, pressure loss can be avoided and the blower 6 can be efficiently operated.

Figure 7:
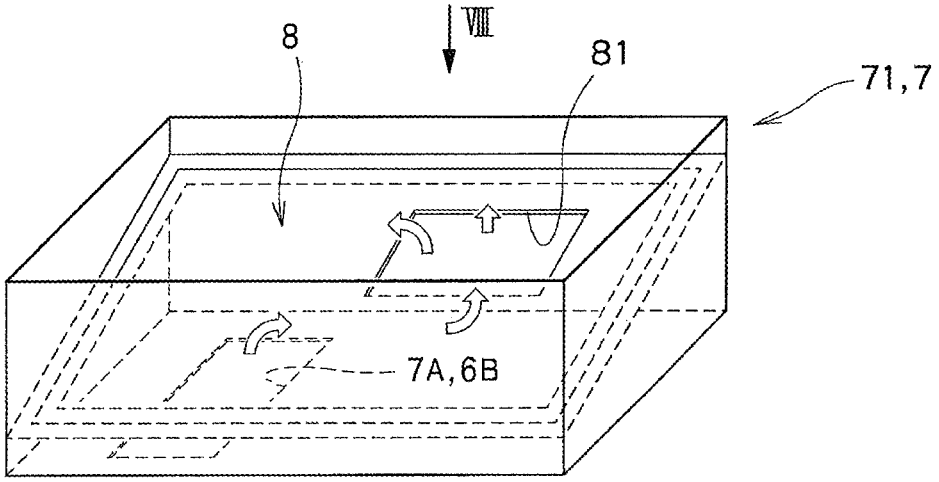
FIG. 7 is a perspective view of a chamber of an air conditioner according to a modification example of the first embodiment of the present invention.
Figure 8:
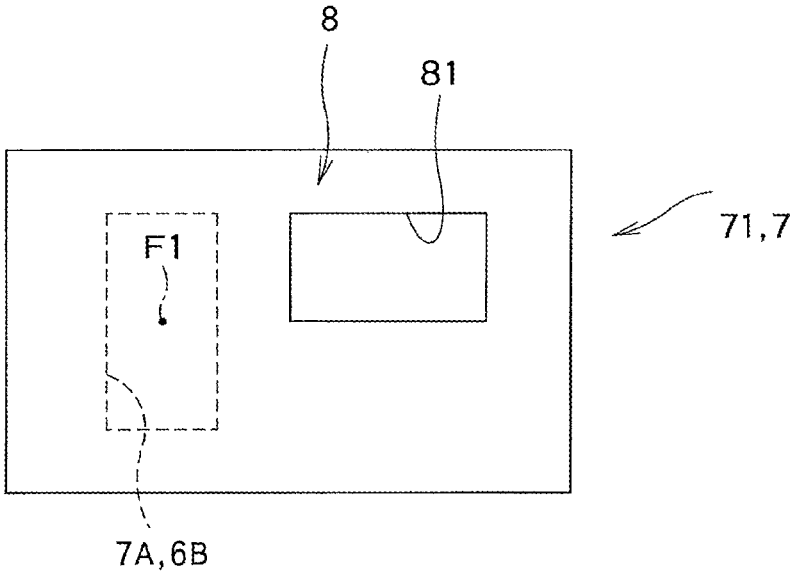
FIG. 8 is a view showing the chamber when seen along a direction of an arrow VIII of FIG. 7.

Herebelow, a modification example of the first embodiment is described with reference to FIGS. 7 and 8. FIG. 7 is a perspective view of a chamber 7 of an air conditioner according to this modification example. FIG. 8 is a view showing the chamber 7 when seen along a direction of an arrow VIII of FIG. 7. A structure in this modification example, which is the same as that of the aforementioned first embodiment, has the same reference numeral, and description thereof is omitted.

In the illustrated example, the air-through opening 81 of the baffle plate part 8 is disposed at a position that does not overlap with the discharge port 6B, when seen along the flow direction of air passing through the discharge port 6B. Other structures are the same as those of the aforementioned first embodiment. According to such a structure, the direction of air from the discharge port 6B is firstly turned by the baffle plate part 8, and then the air hits the peripheral portion of the air-through opening 81 so that turbulence can be generated on the downstream side. This modification example has an advantage that stirring of air itself, as well as stirring of air and vapor can be effectively promoted.

Second Embodiment

Figure 9:
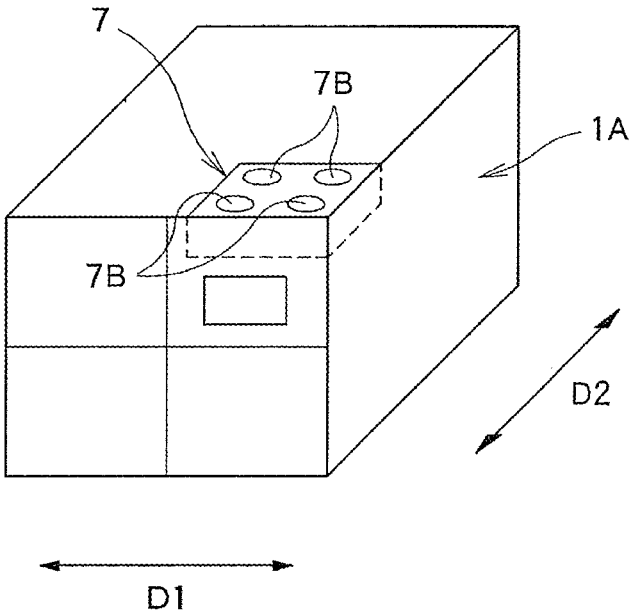
FIG. 9 is a perspective view of an air conditioner according to a second embodiment of the present invention.
Figure 10:
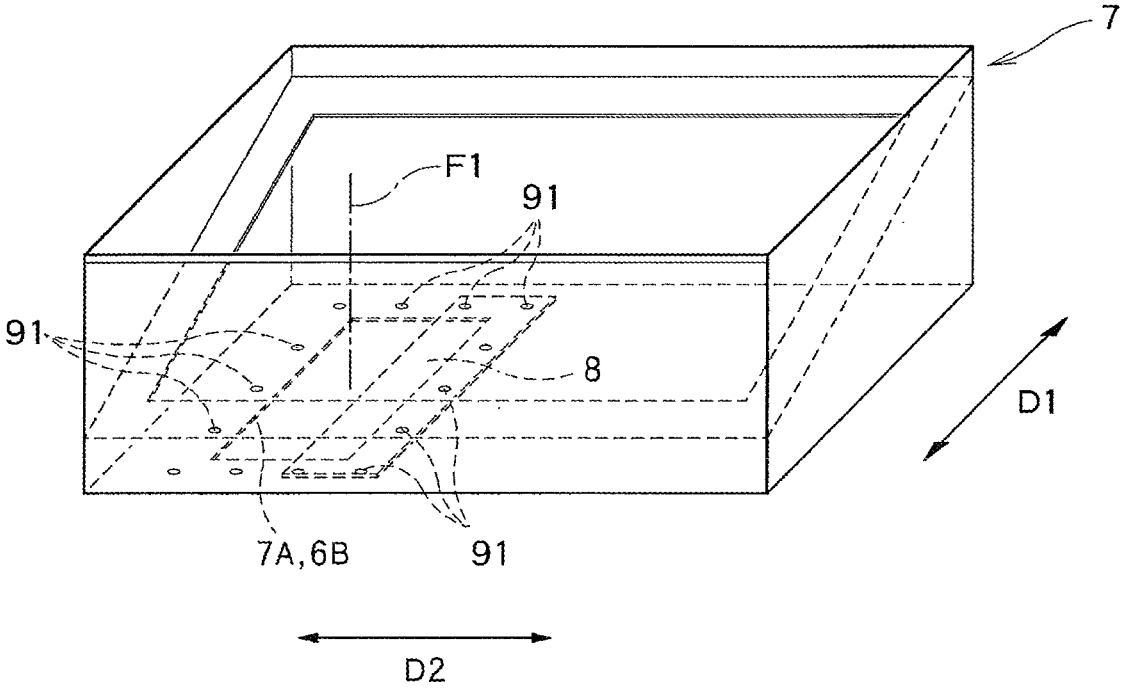
FIG. 10 is a perspective view of a chamber of the air conditioner shown in FIG. 9.
Figure 11:
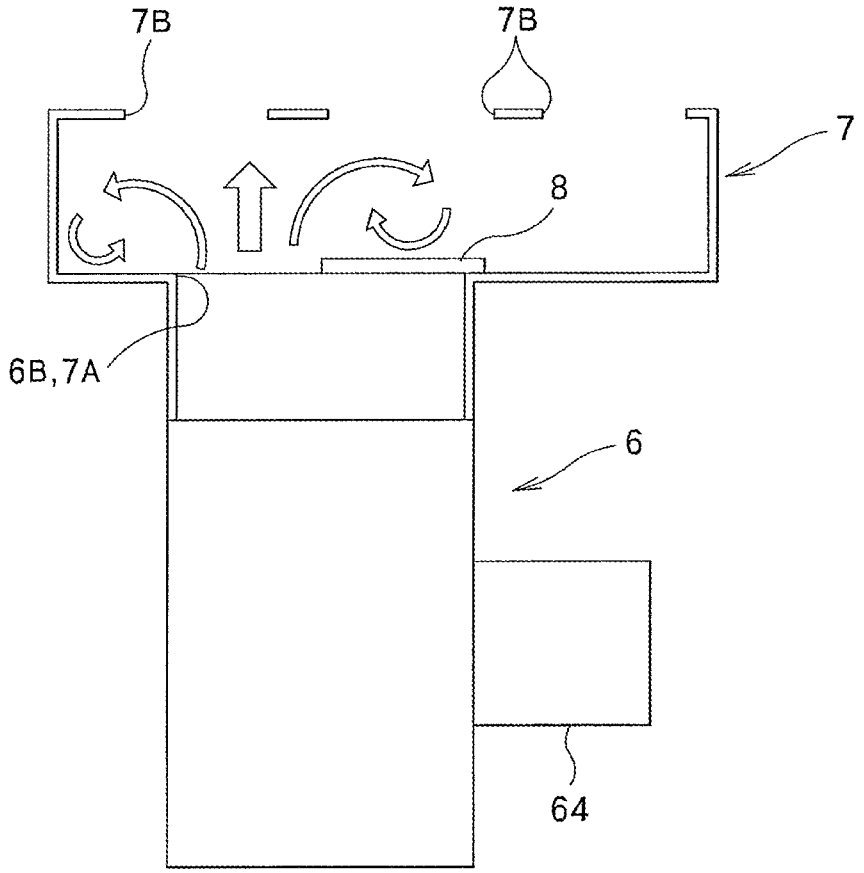
FIG. 11 is a schematic view of a blower and the chamber of the air conditioner shown in FIG. 9.

Next, an air conditioner according to a second embodiment of the present invention is described with reference to FIGS. 9 to 11. FIG. 9 is a perspective view of an air conditioner according to the second embodiment. FIG. 10 is a perspective view of a chamber according to the second embodiment. FIG. 11 is a schematic view of a blower and the chamber according to the second embodiment. A structure in the second embodiment, which is the same as that of the aforementioned first embodiment has the same reference numeral, and description thereof is omitted.

As shown in FIGS. 9 to 11, in the second embodiment, the chamber 7 is disposed inside the housing 1A such that the upper wall of the chamber 7 is flush with an upper outer surface of the housing 1A. A plurality of the duct connection ports 7B are disposed in the upper wall of the chamber 7. On the other hand, the baffle plate part 8 disposed in the chamber 7 is fixed on a circumference of the communication port 7A in the chamber 7. At least a portion of the baffle plate part 8, which overlaps with the discharge port 6B in the flow direction of air passing through the discharge port 6B, extends along a direction orthogonal to the flow direction of air passing through the discharge port 6B (axis F1).

In addition, the circumference of the communication port 7A in the chamber 7 is provided with a plurality of spaced attachments 91 for attaching the baffle plate part 8. The attachments 91 may be bolt holes.

According to the aforementioned second embodiment, as shown in FIG. 11, since air passing through the discharge port 6B of the blower 6 hits on the baffle plate part 8, the air flow changes so that turbulence can be generated in the chamber 7. Thus, turn of air or turbulence can be generated by a significantly simple structure, and it is possible to stir air itself as well as stir air and vapor contained therein in the chamber 7.

In addition, the circumference of the communication port 7A in the chamber 7 is provided with a plurality of the attachment 91 for attaching the baffle plate part 8. Thus, the baffle plate part 8 can be installed in various directions by means of the attachments 91, whereby a stirring action and efficient air passing can be flexibly controlled, resulting in improvement in handling convenience.

Figure 12:
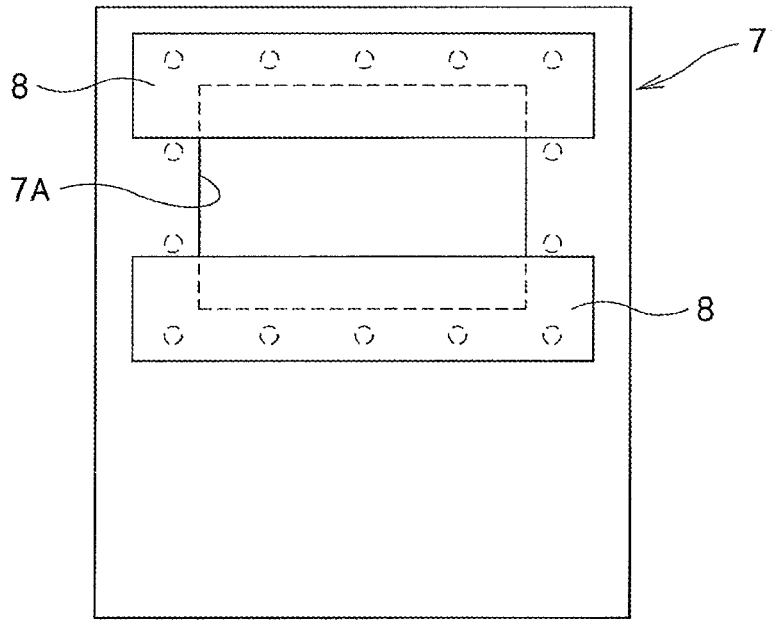
FIG. 12 is a view showing a chamber of an air conditioner according to a modification example of the second embodiment of the present invention.
Figure 13:
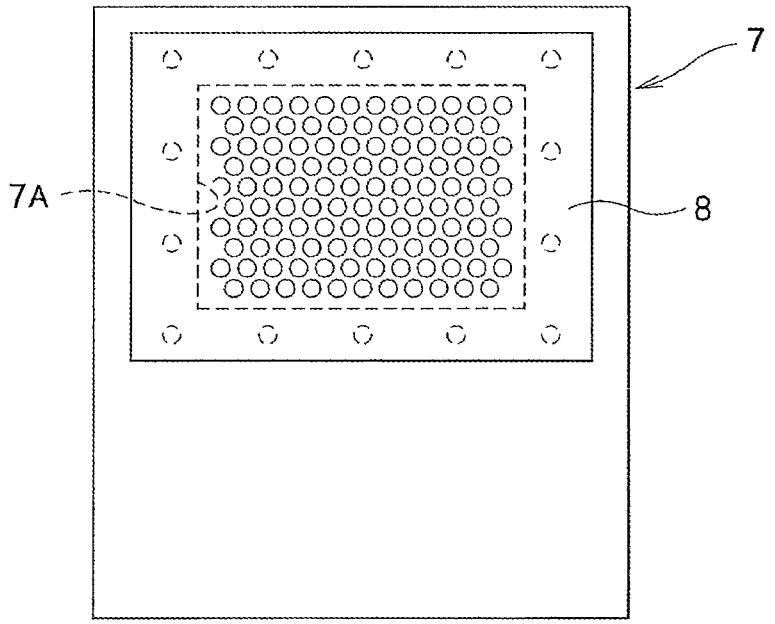
FIG. 13 is a view showing a chamber of an air conditioner according to another modification example of the second embodiment of the present invention.

Herebelow, modification examples of the second embodiment are described with reference to FIGS. 12 and 13. FIG. 12 is a view showing a chamber 7 according to a modification example of the second embodiment. FIG. 13 is a view showing a chamber according to another modification example of the second embodiment.

In the modification example shown in FIG. 12, two baffle plate part 8 are disposed on the circumference of the communication port 7A in the chamber 7. The number of the baffle plates 8 is not specifically limited.

In the modification example shown in FIG. 13, the baffle plate part 8 is formed by a punching plate that is fixed to cover the whole circumference of the communion port 7A. Namely, the baffle plate part 8 has a plurality of punching holes. In this case, the flow direction of air passing through the discharge port 6B can be widely turned, and turbulence can be generated widely.

Third Embodiment

Figure 14:
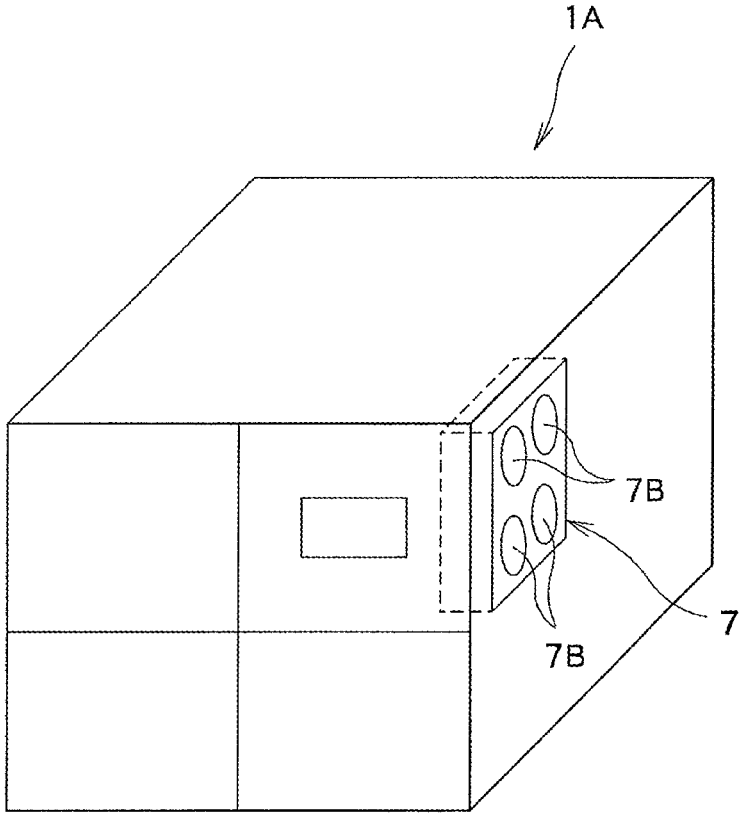
FIG. 14 is a perspective view of an air conditioner according to a third embodiment of the present invention.

Next, an air conditioner according to a third embodiment of the present invention is described with reference to FIG. 14. As shown in FIG. 14, in this embodiment, the chamber 7 is disposed inside the housing 1A such that a wall of the chamber 7, which is provided with the duct connection ports 7B, is flush with a lateral outer surface of the housing 1A. As shown in this embodiment, the position of the chamber 7 is not specifically limited.

The plurality of embodiments of the present invention have been described, but the present invention is not limited to these embodiments and each embodiment can be variously modified differently from the aforementioned modification examples.

1 Air conditioner
2 Air flow path
3 Cooling unit
4 Heating unit
5 Humidifier
6 Blower
6A Suction port
6B Discharge port
61 Impeller
62 Spiral casing part
62S Winding start portion
62E Winding end portion
621 Circumferential plate part
63 Duct part
7 Chamber
7A Communication port
7B Duct connection ports
71 Upstream half
72 Downstream half
8 Baffle plate part
8A, 8B End
81 Air-through opening
91 Attachment

What is claimed is:

1. An air conditioner comprising:

an air flow path through which air flows;

a temperature control unit that controls a temperature of air in the air flow path;

a humidifier capable of controlling a humidity of the air;

a blower that has a suction port connected to a downstream opening of the air flow path, and a discharge port from which air sucked from the suction port is discharged;

a chamber that has a communication port connected to the discharge port, and a plurality of duct connection ports configured to be connectable to ducts so as to let out air coming from the discharge port through the ducts; and a baffle plate part disposed in the chamber, the baffle plate part overlapping at least partly with the discharge port when seen along a flow direction of air passing through the discharge port; wherein the baffle plate part extends along a direction that diagonally intersects the flow direction of air passing through the discharge port;

the baffle plate part has an air-through opening that passes therethrough in a thickness direction, and the baffle plate part is disposed in the chamber such that an airtightness is formed between a whole outer circumference of the baffle plate part and an inner circumferential surface of the chamber; and the air-through opening is disposed at a position closer to a distal end of the baffle plate part than a center of the baffle plate part between a proximal end of the baffle plate part and the distal end of the baffle plate part, with the distal end of the baffle plate part being farther from the discharge port than the proximal end of the baffle plate part is from the discharge port, and another air-through opening is not disposed between the air-through opening and the proximal end of the baffle plate part.

2. The air conditioner according to claim 1, wherein the air-through opening is disposed such that a part of the air-through opening overlaps with the discharge port and that a remaining part of the air-through opening does not overlap with the discharge port, when seen along the flow direction of air passing through the discharge port.

3. The air conditioner according to claim 1, wherein the air-through opening is disposed at a position that does not overlap with the discharge port, when seen along the flow direction of air passing through the discharge port.

* * * * *